US007459842B2

(12) United States Patent
Shiraga et al.

(10) Patent No.: US 7,459,842 B2
(45) Date of Patent: Dec. 2, 2008

(54) SELF-LUMINOUS ELEMENTS AND METHOD FOR PRODUCING THE SAME

(75) Inventors: Takao Shiraga, Mobara (JP); Hirokazu Takanashi, Mobara (JP); Yoshimasa Uzawa, Mobara (JP); Yoshitaka Kagawa, Mobara (JP)

(73) Assignee: Futaba Corporation, Mobara-shi, Chiba-ken (JP)

( * ) Notice: Subject to any disclaimer, the term of this patent is extended or adjusted under 35 U.S.C. 154(b) by 435 days.

(21) Appl. No.: 11/042,430

(22) Filed: Jan. 25, 2005

(65) Prior Publication Data

US 2005/0162067 A1 Jul. 28, 2005

(51) Int. Cl.
*H01J 1/62* (2006.01)

(52) U.S. Cl. ..... 313/495; 313/553; 313/562; 313/549; 252/181.2

(58) Field of Classification Search ..... 313/495–497, 313/545–566, 306, 309–310, 346, 351, 355, 313/293–304
See application file for complete search history.

(56) References Cited

U.S. PATENT DOCUMENTS

| | | | | |
|---|---|---|---|---|
| 2,023,707 | A * | 12/1935 | Spanner et al. | 445/12 |
| 6,686,678 | B2 * | 2/2004 | Suk et al. | 313/292 |
| 6,838,822 | B2 * | 1/2005 | Yonezawa et al. | 313/562 |
| 6,963,165 | B2 * | 11/2005 | Park et al. | 313/495 |
| 2002/0146853 | A1 * | 10/2002 | Karpov et al. | 438/20 |

FOREIGN PATENT DOCUMENTS

| | | | |
|---|---|---|---|
| JP | 02-177234 | | 7/1990 |
| JP | 07-282728 | | 10/1995 |
| JP | 2000-509899 | | 8/2000 |
| JP | 2000-340140 | | 12/2000 |
| JP | 2001-076653 | | 3/2001 |
| JP | 2002-343233 | | 11/2002 |
| JP | 2003171177 | A * | 6/2003 |
| JP | 2003-242914 | | 8/2003 |
| WO | 98/39788 | | 9/1998 |
| WO | WO0054307 | A1 | 9/2000 |

OTHER PUBLICATIONS

Patent Abstracts of Japan 07-282728 dated Oct. 27, 1995.
Patent Abstracts of Japan 2000-340140 dated Dec. 8, 2000.
Patent Abstracts of Japan 2001-076653 dated Mar. 23, 2001.
Patent Abstracts of Japan 2002-343233 dated Nov. 29, 2002.

* cited by examiner

*Primary Examiner*—Mariceli Santiago
*Assistant Examiner*—Donald L Raleigh
(74) *Attorney, Agent, or Firm*—Quarles & Brady LLP

(57) ABSTRACT

A vacuum retention agent, which is safe, easy to handle, saves space, and absorbs residual gases inside a hermetic envelope to maintain the hermetic envelope in a high degree of vacuum is provided in place of the conventional metal getter. A display device including the vacuum retention agent is provided. A gas occlusion material containing $ZrO_x$ (where $1 \leqq x \leqq 2$) is disposed in a hermetic envelope forming a self-luminous element. ZrOx is formed in pattern from a paste of zirconium dioxide, which can be generally obtained as a reagent. In a production step, the patterned self-luminous element is hermetically sealed in vacuum in an atmosphere at 120° C. to 500° C., so that the vacuum retention effect is more improved.

6 Claims, 9 Drawing Sheets

SELF-LUMINOUS ELEMENTS AND METHOD FOR PRODUCING THE SAME

CROSS REFERENCES TO RELATED APPLICATIONS

This application claims the priority benefit of Japanese Patent Application No. 2004-017709 filed on Jan. 26, 2004.

STATEMENT REGARDING FEDERALLY SPONSORED RESEARCH

Not Applicable.

BACKGROUND OF THE INVENTION

1. Field of the Invention

The present invention relates to self-luminous elements including a fluorescent substance layer having fluorescent substances in a hermetic enclosure, where a fluorescent substance light-emits due to electron beam excitation. Particularly, the present invention relates to self-luminous elements, each having a new gas occlusion material for occluding unnecessary gases, which is disposed in an envelope to make and maintain a high degree of vacuum degree inside the enclosure.

2. Description of the Prior Art

In self-luminous elements, an envelope is hermetically sealed to maintain the inside thereof in a hermetic state. Such a closed space is maintained to a high degree of vacuum, such as less than $1\times10^{-3}$ Pa. To realize such a state, high-melting point metal materials, such as Ti, Mo, Ba, Zr, and the equivalents, each which has the function of absorbing residual gases and removing them from the gas phase, have been used as getter materials (hereinafter, referred to as getter).

A fluorescent display tube, shown in FIG. 14, is a type of self-luminous element that light-emits an electron beam excitation luminous material such as a fluorescent substance. The fluorescent display tube includes an electron source 600 disposed in a vacuum hermetic envelope, and an anode having a fluorescent substance layer 400 on which a fluorescent substance, which glows due to impingement of electrons irradiated from the electron source, is coated. It is required to maintain the inside of the vacuum hermetic envelope in a hermetic state and to maintain the inner surface of the vacuum envelope and the surface of the fluorescent substance in a clean state.

In conventional self-luminous elements employing the electron beam excitation emission, an expensive getter ring 110, which has a metal container filled with a getter material such as Ba—Al alloy, is used to maintain the inner surface of the vacuum hermetic envelope in a high degree of vacuum and to maintain the inner surface of the envelope and the surface of the fluorescent substance in a clean state.

In plasma display devices being self-luminous elements, unnecessary gases, other than the display gas such as a plasma excitation gas, that form within or enter the envelope after it has been evacuated to a high degree of vacuum, adversely affect the operational life of the device. Therefore, it is required to remove unnecessary gases inside the plasma display device.

In order to maintain the luminous characteristics of an EL display device being a self-luminous element, after the luminous elements have been sealed inside the envelope, the inside thereof must be maintained to minimize the formation or introduction of unnecessary gases. FIG. 14 depicts a getter for fluorescent display tube being one of electron beam excitation luminous elements. An expensive getter ring 110, which has a metal container filled with a getter material such as Ba—Al alloy, is heated with high-frequency induction to form an evaporation film.

As to the getters for fluorescent display tubes, various techniques have been developed to prevent harmful effects due to the high-frequency induction heating. For example, as shown in FIG. 14, the magnetic core 802 is placed around the high-frequency induction heating core 803 to prevent the spreading of magnetic field. (For example, refer to Japanese Patent Laid-open Publication No. Tokkai-hei 7-282728 and Japanese Patent Laid-open Publication No. Tokkai 2001-76653) However, the problem is that the above-mentioned getter ring is expensive and requires a space for installation in the vacuum envelope and requires labor for mounting a getter ring.

A technique has been disclosed for preventing the problem of forming an evaporation film through the r-f induction heating of the getter ring and of effectively using the man-power and the space (for example, refer to Patent Publication No. WO00/54307). In this technique, a non-evaporation type getter (NEG) formed of metals of one or more types or an alloy of them, on the upper surface of an insulating substrate constituting a display element is fabricated through a printing method or sputtering method. The metals are selected from the group consisting of Ti, Cr, Al, V, Nb, Ta, W, Mo, Th, Ni, Fe, and Mn. The non-evaporation type getter (NEG), however, is expensive and requires the activation workability.

Moreover, there is a technique for preventing the trouble occurring when an evaporation film is formed by h-f heating a getter ring being a getter material for a fluorescent display tube and effectively using the man-power and the space. In this technique, a Ba—Al alloy or Mg—Al alloy, which does not contain an additive metal such as Ni, is press molded in a disk, oval, or rectangular shaped getter. Then, the getter is mounted in the electron tube such as a fluorescent display tube, using metal wires or fritted glass. The technique of flushing the getter through the laser beam heating and thus forming a getter mirror film has been disclosed (for example, refer to Japanese Patent Laid-open Publication No. Tokkai-hei No. 2002-343233).

In addition to the technique of using a metal having the getter effect and maintaining a clean atmosphere in the vacuum envelope, the technique of using $TiO_2$ or $ZnO_2$ as an auxiliary getter material is disclosed as described below. $TiO_2$ and $ZnO_2$ are used as a getter material. However, if a material absorbs O or H, other chemicals may be mixed in a getter material. Such materials are dissolved in a fixing solution to make a solution, and then the solution is coated on support members. The concentration of the getter material in the coating solution is set to 2 to 5 wt %. However, the fixing solution evaporates during the sealing step and is drawn out. Finally, the titanium oxide remains as a getter material.

In order to effectively derive the absorption effect of the getter mixed in the fixing material 10, it is effective to bake the substrate above at least 400° C. That is, the technique is disclosed of improves the getter effect by deoxidizing $TiO_2$ into TiO or Ti through the baking step (refer to Japanese Patent Laid-open Publication No. Tokkai No. 2000-340140). However, this technique has a problem in a practical use because only an auxiliary effect of creating and maintaining a high degree of vacuum degree was confirmed.

In order to maintain a high degree of vacuum such as $1\times10^{-3}$ Pa in the closed space, such as the vacuum display device of the present invention, materials, having the function of absorbing residual gas molecules and removing them from the gas phase, for example, high melting point metal materials, such as Ti, Mo, Ba, and Zr, have been employed as getter materials. The Ba series getters have been practically used as getters generally usable in a temperature range of 140° C. to 120° C. However, a high melting point metal material, such as Ti, Mo, or Zr, has not been used practically as a getter material. Powders of high melting point metal, being the getter material, may generally be unstable because it can catch fire when in contact with the air. Moreover, the metal powders do not often have a sufficient gas occlusion capability.

Various techniques have been developed to obtain getter materials, which are safe and easy to handle, and to improve the occlusion efficiency of residual gases of a getter material. The problem, however, is that any one of those techniques requires a room for disposing a getter material and requires the step of activating the surface of the metal getter material though h-f induction heating or resistance heating after the getter material has been placed in the envelope.

SUMMARY OF THE INVENTION

The present invention is made to solve the above-mentioned problems.

An object of the present invention is to provide a gas occlusion material, which is safe, easy to handle, saves space, and absorbs residual gases inside a hermetic envelope to maintain the hermetic envelope in high vacuum degree, in place of the conventional metal getter.

Another object of the present invention is to provide a display device using the gas occlusion material to solve the following problems.

In self-luminous elements using the electron beam excitation emission, the vacuum hermetic enclosure is maintained in high vacuum degree while both the inner surface of the enclosure and the surface of the fluorescent substance are maintained clean.

In the plasma display devices being self-luminous elements, it is said that unnecessary gases, other than gas for displaying such as plasma generation gas, generated and invaded after an enclosure has been evacuated in high vacuum adversely affect the operational life of the device. Accordingly, the unnecessary gases inside the plasma display device are removed.

In order to maintain the luminous characteristics of an EL display device, or a self-luminous element, the cleaning degree is maintained so as to exclude internal unnecessary gases after luminous elements are sealed inside the enclosure.

In order to solve the above-mentioned problems, the present invention uses a relatively safe $ZrO_x$ (where $1 \leqq x \leqq 2$). According to the present invention, a gas occlusion material containing a zirconium dioxide is disposed in a hermetic envelope so as to be exposed in an atmosphere in the hermetic envelope. Thus, the gas occlusion material absorbs undesired gases inside the hermetic envelope of a self-luminous element, thus improving the reliability of the self-luminous element.

In another aspect of the present invention, a self-luminous element comprises a gas occlusion material containing a zirconium dioxide; a member on which the gas occlusion material is coated, the member being disposed in a hermetic envelope so as to be exposed in an atmosphere in the hermetic envelope.

In further another aspect of the present invention, a self-luminous element comprises a vacuum hermetic envelope; an electron source disposed inside the vacuum hermetic envelope; a fluorescent substance layer disposed inside the vacuum hermetic envelope, for light emitting in response to electrons irradiated from the electron source; and a gas occlusion material disposed inside the vacuum envelope, the gas occlusion material containing $ZrO_x$ (where $1 \leqq x \leqq 2$); the gas occlusion material being disposed so as to be exposed to an atmosphere in the hermetic enclosure.

In the self-luminous element according to the present invention, the electron source comprises a filament-like electron source.

In the electron tube according to the present invention, the electron source comprises a field emission electron source.

In the electron tube according to the present invention, the gas occlusion material having a conductivity and containing $ZrO_x$ (where $1 \leqq x \leqq 2$) is exposed in an atmosphere inside the hermetic enclosure.

In the self-luminous element according to the present invention, the gas occlusion material containing $ZrO_x$ (where $1 \leqq x \leqq 2$) is formed in a film state over an inner surface of the hermetic enclosure.

In the self-luminous element according to the present invention, the gas occlusion material containing $ZrO_x$ (where $1 \leqq x \leqq 2$) is formed in a film state on the upper surface of an insulating layer overlying an inner surface of the hermetic enclosure.

In the self-luminous element according to the present invention, the gas occlusion material containing $ZrO_x$ (where $1 \leqq x \leqq 2$) is formed to a grid member disposed above the fluorescent substance layer.

In the self-luminous element according to the present invention, the gas occlusion material containing $ZrO_x$ (where $1 \leqq x \leqq 2$) is coated on a filament support member disposed on an inner surface of the hermetic enclosure.

In the self-luminous element according to the present invention, the gas occlusion material containing $ZrO_x$ (where $1 \leqq x \leqq 2$) is coated on a core line disposed in a space on an inner surface of the hermetic enclosure.

In the self-luminous element according to the present invention, the gas occlusion material containing $ZrO_x$ (where $1 \leqq x \leqq 2$) comprises an anode electrode acting as a base electrode formed on an inner surface of the hermetic enclosure.

In the self-luminous element according to the present invention, the gas occlusion material containing $ZrO_x$ (where $1 \leqq x \leqq 2$) is formed a spacer member for a flat grid disposed around the fluorescent layer.

In further another aspect of the present invention, a method for producing a self-luminous element comprises the steps of disposing a gas occlusion material containing $ZrO_x$ (where $1 \leqq x \leqq 2$) at a portion of a vacuum envelope; forming a display device envelope which contains the gas occlusion material; and raising the display device envelope to a temperature of 120° C. to 600° C.

In still further aspect of the present invention, a method for producing a self-luminous element comprises the steps of disposing a gas occlusion material containing $ZrO_x$ (where $1 \leqq x \leqq 2$) at a portion of a vacuum envelope; forming a display device envelope which contains the gas occlusion material; and hermetically sealing the display device envelope in vacuum at a temperature of 300° C. to 400° C.

The present invention can provide a gas occlusion material, which is safer than the conventional metal getter, is easy to handle, saves the space, and absorbs residual gases inside a hermetic envelope to maintain the hermetic envelope in high vacuum degree. The gas occlusion material containing $ZrO_x$ (where $1 \leqq x \leqq 2$), which is a safe material, can be disposed as various members, constituting a self-luminous element, inside a hermetic envelope. Thus, in an atmosphere of the hermetic envelope, the gas occlusion material can effectively maintain the inside of the hermetic envelope in a clean state.

In self-luminous elements using electron beam excitation emission, the gas occlusion material can maintain the inside of the vacuum hermetic envelope in high vacuum degree and can clean the inner surface of the envelope and the fluorescent substance surface.

In plasma display devices being self-luminous elements, it is generally accepted that after the inside of an envelope is evacuated in high vacuum, the generation and/or invasion of gases, other than gases needed for display, such as plasma generation gas, adversely affect the operational life of the fluorescent display. Undesired gases inside the plasma display device must be removed to maintain the safe hermetic envelope atmosphere.

In order to maintain the luminous characteristics of EL display devices being self-luminous elements, after luminous elements are sealed inside an envelope, the gas occlusion material can effectively maintain the envelope in no existence of internal unnecessary gases.

BRIEF DESCRIPTION OF THE DRAWINGS

This and other objects, features, and advantages of the present invention will become more apparent upon reading of the following detailed description and drawings, in which.

DESCRIPTION OF THE EMBODIMENTS

A distributed type getter and a contact-type getter are known as means for achieving a high vacuum degree using a getter. The distributed type getter absorbs gas molecules by reacting and combining with gas molecules with a vapor of the getter generated through chiefly evaporating or sputtering Ba, Mg, Ca, and others and then by evaporating them onto a solid surface. In the contact-type getter, a getter is evaporated onto the surface of a solid such as Ti, Ta, Zr, or V and then the resultant clean getter surface captures gas molecules.

The metal, Zr, used as the contact-type getter material makes an oxide film indicating a strong corrosion resistance on the surface thereof in air. However Zr is characterized in that the powder thereof catches fire easily.

It is believed that any one of the distributed-type getter and the contact-type getter works as a gas occlusion material, which occludes gaseous molecules and atoms through the chemical reaction of a metal or metal alloy and gas molecules.

Zirconium oxide has two types, that is, a low temperature type (monoclinic system) and a high temperature type (pyramidal quadratic system). It is known that the transition temperature occurs in vicinity of 1000° C. reversibly and endothermically. Moreover, it is known that zirconium has a high oxygen defect. For that reason, the present inventor supposed that because the oxygen defect transmits oxygen ions at high temperatures, it would have the mechanism of absorbing gas molecules. It was considered to use $ZrO_x$ (where $1 \leqq x \leqq 2$) as a gas occlusion material equivalent to the getter material for the display device.

Fluorescent display tubes, using a getter ring as a gas occlusion material acting as both the distributed-type getter and the contact-type getter, were fabricated as comparative objects.

Zeolite series molecular sieve (synthetic zeolite having fine pores of 4 nm industrially manufactured by Linde Co.), used as an absorbent material having a high physical absorption capability such as moisture absorbent or carbon dioxide, is known in public as a physical gas occlusion material. The getter material using the zeolite series molecular sieve was built in a fluorescent display tube. Thus, it was evaluated whether or not the trial getter material can be used as a gas occlusion material for fluorescent display tubes.

COMPARATIVE EXAMPLE 1

Figure 14:
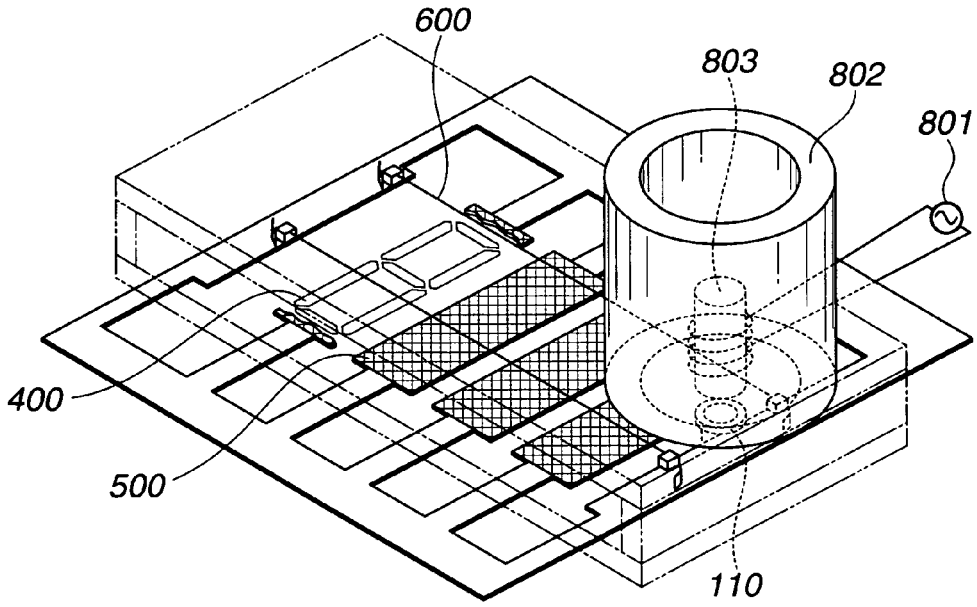
FIG. 14 is a schematic diagram illustrating a conventional embodiment.

Comparative example 1 is an example of a fluorescent display tube using a conventional getter ring. As shown in FIG. 14, a thin film of aluminum is formed over the upper surface of a glass substrate 000, which has 25 mm in width× 50 mm in length. Then, the aluminum thin film is patterned through the photolithographic process to form a wiring conductor pattern (not shown). An insulating layer 200 including mainly low melting point glass is formed on the upper surface of the wiring conductor pattern. Through holes are formed in the insulating layer 200 to communicate with the wiring conductors. An anode conductor 300 containing graphite as a main component is formed and baked on the upper surface of the insulating substrate so as to block the through holes (if necessary, the through holes are filled with a conductive material).

Thereafter, a fluorescent substance layer 400 for low velocity electron beams is formed on the upper surface of the anode conductor through the screen printing process. Then, the intermediate structure is baked at 450° C. to complete an anode substrate.

The anode substrate, a conventional getter ring 110, a filament 600, and a grid electrode 500 are integrated. A boat container 700 is assembled with the glass substrate 000 (of 25 mm in width×50 mm in length). A complete envelope is fabricated by sealing the boat container of 25 mm in width×50 mm in length×3 mm in height with a low melting point glass in an atmosphere of 400° C. to 500° C.

Next, gases remaining in the envelope are drawn out in an atmosphere of 400° C. to 500° C., so that a fluorescent display tube hermetically sealed in vacuum is fabricated. Thereafter, the getter was heated through h-f induction heating so that a sample in a high vacuum state was fabricated. Moreover, the fluorescent display tube hermetically sealed in vacuum was stored in an oven at 100° C. to 300° C. and then was subjected to aging. Thus, a fluorescent display tube was completely produced.

COMPARATIVE EXAMPLE 2

Comparative example 2 shows an example in that a gas occlusion material containing zeolite series molecular sieve is disposed as an occlusion layer on the upper surface of the insulating layer of the anode substrate. Zeolite series molecular sieve (synthetic zeolite having fine pores of 4 nm industrially manufactured by Linde Co.) is used as an absorbent material having a high physical absorption capability such as moisture absorbent or carbon dioxide. Various products are used according to sizes of fine pores.

The following fluorescent display tubes were prepared for comparison to examine whether or not the above mentioned materials can be used as gas occlusion materials for fluorescent display tubes.

Specifically, in the fluorescent display tube shown in FIG. 14, the getter ring 110 is omitted. A gas occlusion material forming paste of 15 mm×30 mm containing zeolite series molecular sieve is printed on the upper surface of the glass substrate 000 (of 25 mm in width×50 mm in length) in an empty area (not including the anode conductor) of the upper surface of the insulating layer. Then, the intermediate structure is baked in an air atmosphere at about 450° C. After baking, the weight of the gas occlusion layer 100 was about 6 mg.

Thereafter, a boat container (of 25 mm in width×50 mm in length×3 mm in height) is hermetically sealed with a low melting point glass in an atmosphere of 400° C. to 500° C. to make a fluorescent display tube.

The following examples 3A, 4A, 5A, and 13X were used as the zeolite series molecular sieve.

A gas occlusion material forming paste containing the zeolite series molecular sieve is prepared by mixing a mixed solvent of butyl-carbitol and terpinenol in a vehicle in which ethyl cellulose is dissolved.

3A: A product having an effective diameter of less than 0.3 nm, which absorbs $H_2O$, $NH_3$, and He.

4A: A product having an effective diameter of less than 0.4 nm, which absorbs $H_3S$, $CO_2$, $C_2H_2$, $C_3H_3OH$, and $C_6H_6$.

5A: A product having an effective diameter of less than 1.0 nm, which absorbs n-paraffin, n-olefin, and n-$C_4H_9OH$, $C_3H_3OH$, and $C_6H_6$.

13x: A product having an effective diameter of less than 1.0 nm, which absorbs iso-paraffin, iso-olefin, and di-n-butylamin aromatic series.

Embodiment 1

Figure 1:
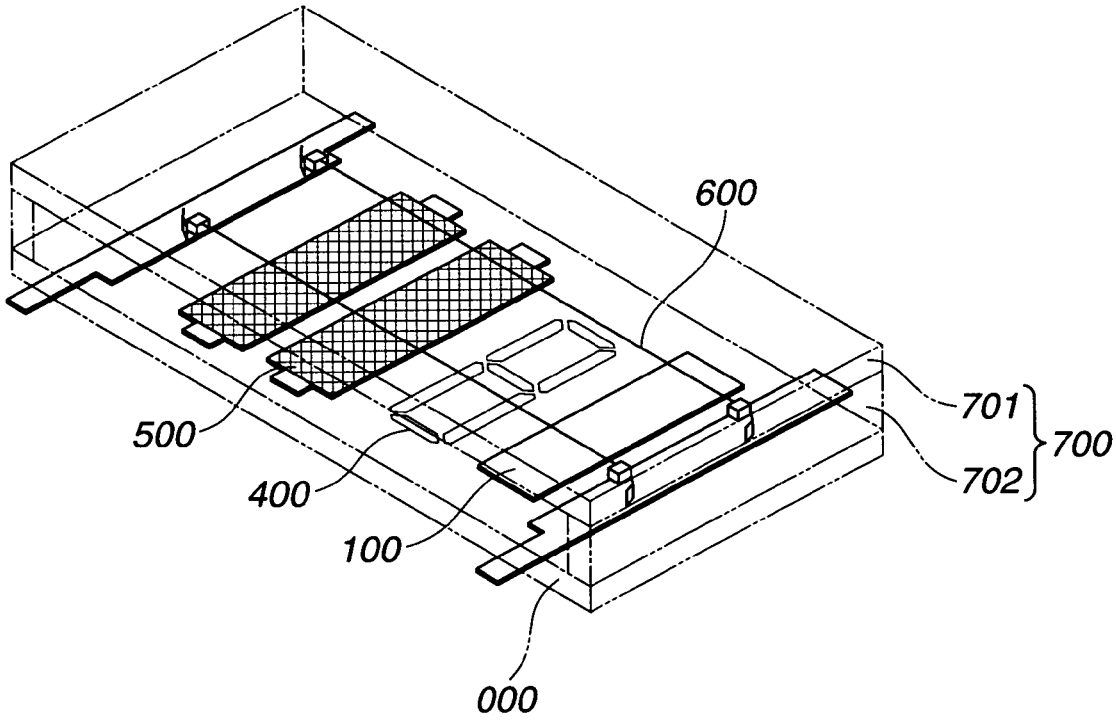
FIG. 1 is a schematic diagram illustrating a self-luminous element, according to a first embodiment of the present invention.

In the embodiment 1, FIG. 1 shows a fluorescent display tube of the present invention in which a gas occlusion material containing zircnium dioxide is disposed as a gas occlusion layer on the upper surface of the anode substrate in a fluorescent display tube.

As shown in FIG. 1, an aluminum thin film is formed on the upper surface of the glass substrate 000 of 25 mm in width×50 mm in length. Then, the aluminum thin film is patterned through the photolithographic process to form a wiring pattern (not shown). An insulating conductor 400 containing a low melting point glass as a main component, which has through holes for connecting the wiring pattern to the anode conductor 400, is formed on the upper surface of the wiring pattern. An anode conductor 300 containing graphite as a main component is formed and baked on the upper surface of the insulating layer (if necessary, conductive materials may be disposed in the through holes).

Thereafter, a fluorescent substance layer 400 for low velocity electron beam is formed on the upper surface of the anode conductor through the screen printing process. Then the intermediate structure is baked at about 450° C. to complete an anode substrate.

Thereafter, the fluorescent substance layer 400 for low velocity electron beam is formed on the upper surface of the anode conductor through the screen printing process. Then, a gas occlusion material forming paste of 15 mm×30 mm containing zirconium dioxide is printed in the area where the anode conductors are not disposed and on the upper surface of the glass substrate 000 of 25 mm in width×50 mm in length. In succession, the printed structure is baked in an air atmosphere at about 450° C. After baking, the weight of the gas occlusion layer 100 was about 6 mg.

Thereafter, the boat container of 25 mm in width×50 mm in length×3 mm in height is sealed in vacuum with a low melting point glass in an atmosphere of 400° C. to 500° C. to fabricate a fluorescent display tube.

The gas occlusion material forming paste containing the zirconium dioxide is prepared by mixing a mixed solvent of butyl-carbitol and terpinenol in a vehicle in which ethyl cellulose is dissolved.

The fluorescent display tubes produced in the comparative examples 1 and 2 and in the embodiment were evaluated according to the following methods.

Figure 13:
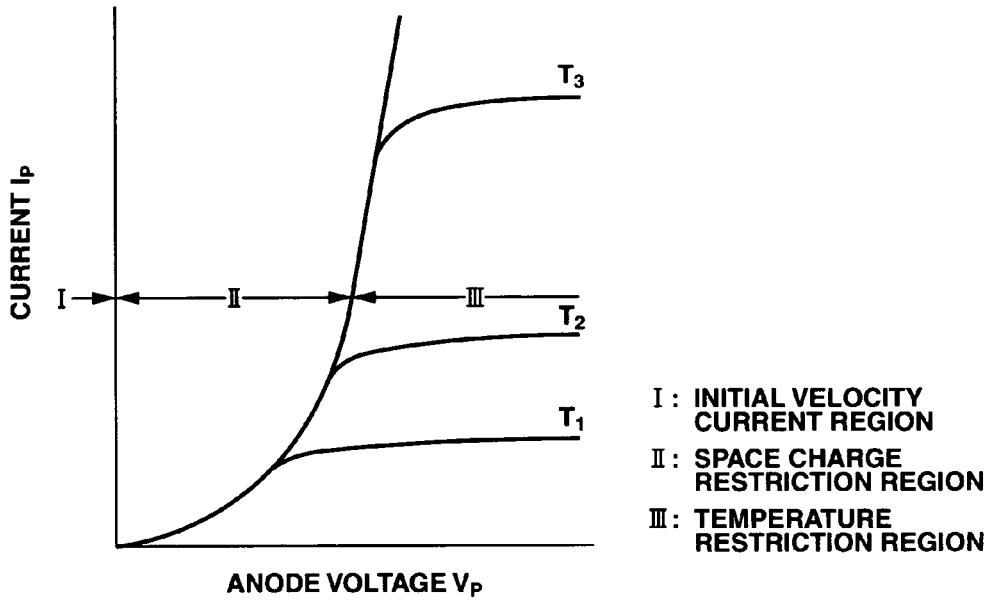
FIG. 13 is a schematic diagram illustrating static characteristics of a typical diode.

As to the electron emission capability of a filament in a fluorescent display tube:

FIG. 13 shows static characteristics of a typical diode, explaining the electron emission capability of a filament in a fluorescent display tube. Referring to FIG. 13, the region I is called an initial velocity current region where electrons having an energy overcoming a negative anode voltage of electrons emitted from a cathode enter into the anode.

As the anode voltage increases from a negative value to a positive value, more electrons emitted from the cathode are accelerated toward the anode. The space between the anode and the cathode is filled with the emitted electrons, so that the state where the cathode is shielded by the electrons is balanced. The region II is called a space charge limited region. As the anode voltage is further increases, the state becomes the temperature-limited region III where the anode current is limited due to the electron emission capability of the cathode. The total current Is from the cathode is represented by the following equation (I) of Richardson and Dushman.

$$Is=SAT^n \exp(-e\Phi/KT) \quad (1)$$

Accordingly, by measuring Is at a constant temperature T in the temperature limited region, the quality of cathode can be evaluated. The measured current Is is used as a pulse emission value for evaluating the electron emission capability of a filament of a fluorescent display tube. Generally, it is targeted that the measured current value exceeds 100%, with respect to standard values being values obtained by a normally operable filament fluorescent display tube (and so forth).

As to gas current:

Here, the electron emission capability of a filament in a fluorescent display device will be explained. In the fluorescent display device, the inside of the hermetic envelope must be maintained at a high vacuum degree of less than $1\times10^{-3}$ Pa but a minute amount of gas still exists in the envelope. In the means for measuring the vacuum degree necessary to maintain the function of a fluorescent display tube, a minute amount of ions are generated when a predetermined positive voltage is applied to the grid in the fluorescent display tube while electrons are emitted from the energized filament.

A current due to the minute ions in the fluorescent display tube is measured when a predetermined positive voltage is applied to the anode disposed in the fluorescent display tube. This value corresponds to a numerical value to evaluate a vacuum degree and is called an ion current. Generally, values obtained by a normally operable fluorescent display device are set as standard values. An ion current less than 100% with respect to a standard value is used as an index of the vacuum degree of a fluorescent display tube (and so forth)

In the fluorescent display tube of the embodiment 1, the initial value of the pulse emission being a target value of the electron emission capability of a filament is 120% to the value of the standard fluorescent display tube. However, in the comparative example 1, the electron emission capability is about 60% of the pulse emission when a voltage is applied to a filament and glowing is made with the thermal electrons for 100 hours. However, the electron emission capability was about 200% with respect to the pulse emission of the fluorescent display tube using the standard Ba—Al getter. This value was equivalent to the Ba—Al getter.

In the fluorescent display tube of the embodiment 1, the initial value of gas current, being an index of vacuum degree, is 110% with respect to that of the standard fluorescent display tube. However, when a filament in the fluorescent display tube is driven with a voltage and emits thermal electrons for 100 hours, the initial value drops to about 80%. This was equivalent to the value in the fluorescent display tube using the standard Ba—Al getter 110.

The gas occlusion layer 100 containing zirconium dioxide is disposed at a portion in an envelope. Thus, it was ascertained that there is the possibility that a gas occlusion effect close to that of the conventional Ba—Al getter 110 can be obtained.

Next, using the fluorescent display devices in the comparative example 1, the comparative example 2, and the embodiment 1, the pulse emission, being an index of the electron emission capability of a filament, and the gas current, being an index of vacuum degree, were evaluated. Thus, it was confirmed whether or not the zirconium dioxide and the zeolite series molecular sieve could be used as the gas occlusion material for a fluorescent display tube.

Figure 15:
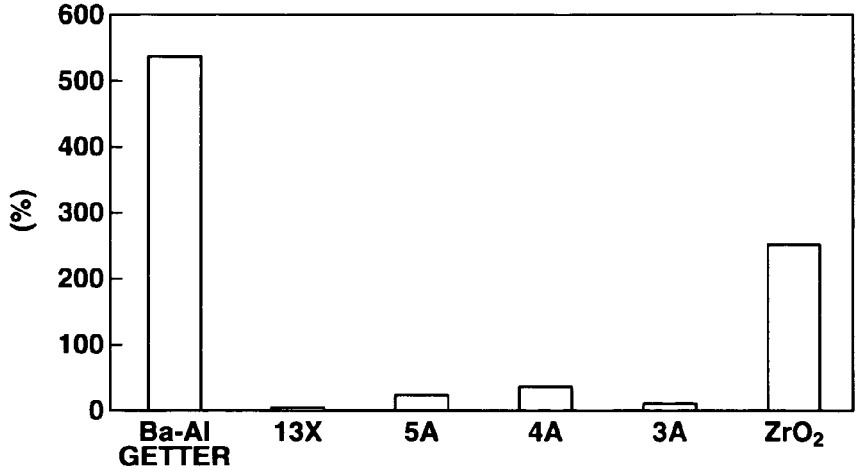
FIG. 15 is a graph showing ratios to electron emission characteristics of fluorescent display tubes, in comparative examples 1, 2 and the embodiment 1.

Referring to FIG. 15, the pulse emission, which indicates the electron emission capability of a filament in the fluorescent display tube in the embodiment 1 using the zirnium dioxide gas occlusion material, is 250% with respect to the minimum required value. However, the pulse emission is half that of the conventional Ba—Al getter in the comparative example 1. In comparison with the fluorescent display tube using the zeolight series molecular sieve (4A), known as the physical absorbent, in the comparative example 2, the pulse emission is about 30% or less. It was ascertained that the embodiment 1 could not be used as a gas occlusion material for a fluorescent display tube.

Figure 16:
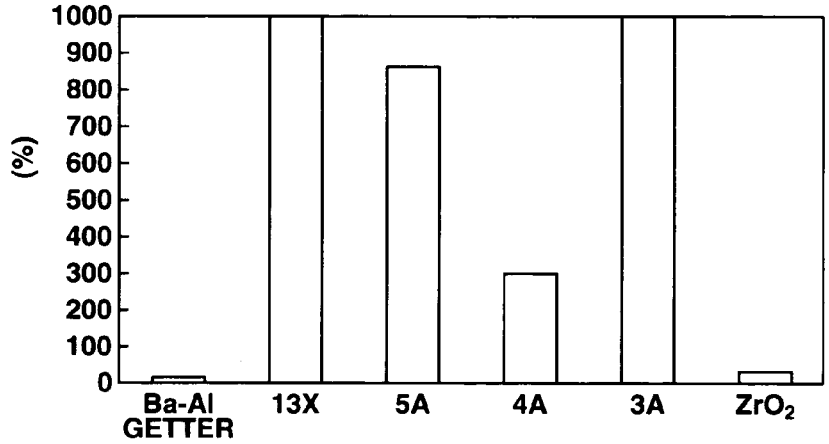
FIG. 16 is a graph showing ratios to gas current of fluorescent display tubes, in comparative examples 1, 2 and the embodiment 1.

FIG. 16 shows a gas current value indicating a minute amount of gas in the fluorescent display tube to evaluate the vacuum characteristic of a fluorescent display tube. The gas current value in the fluorescent display tube in the embodiment 1 using zirconium dioxide gas occlusion material is the same as that in the fluorescent display tube in the comparative example 1, compared with the conventional Ba—Al getter. However, it is understood that the gas current value is about 10% to about 2.5% or less, in comparison with the gas current value in the fluorescent display tube using zeolite series molecular sieve (4A), known as the physical absorbent, in the comparative example 2.

Judging from data mentioned above, it is understood that there is a possibility that the fluorescent display tube in the embodiment 1, in which a zirconium dioxide gas occlusion material is disposed at a portion in a vacuum envelope, can provide a gas occlusion effect close to that of the fluorescent display tube in the comparative example 1 using the conventional Ba—Al getter.

The fluorescent display tube is usually used at a room temperature (about 25° C.), but may be often stored at 85° C. or more according to the specification. In the fluorescent display tube in the embodiment 1, the gas current was measured at 25° C., 50° C., 85° C., and 120° C. and then evaluated at 25° C.

The gas currents at 25° C., 50° C., 85° C., and 120° C., which indicate the vacuum degree of the fluorescent display tube in the embodiment 1, were compared with that of the fluorescent display tube in the comparative example 1 using the conventional Ba—Al getter. At 25° C., the gas current was about 100% of that of the comparative example 1. At 50° C., the gas current was about 150% of that of the comparative example 1. At 85° C., the gas current was about 200% of that of the comparative example 1. At 120° C., the gas current was about 200% of that of the comparative example 1. However, the gas current was about 90% of that of the comparative example 1 when the fluorescent display tube settles to 25° C. after leaving it in an atmosphere at 120° C.

Judging from the results, it was ascertained that zirconium dioxide used as a gas occlusion material can provide the effect identical to that of the conventional Ba—Al getter at normal temperatures. It was ascertained that when the fluorescent display tube settles to a room temperature of 25° C. after storing at 50° C. or more, it can provide a gas occlusion effect identical to that of the fluorescent display tube in the comparative example 1.

The problem arises that when the fluorescent display tube is generally stored at 85° C., brightness decreases due to gases released from the fluorescent substance surface in the fluorescent display tube. When the fluorescent display tube using the conventional Ba—Al getter is driven at a normal temperature (25° C.), the Ba—Al getter absorbs gases unnecessary for the fluorescent display tube, so that stable display is recovered.

The pulse emission indicating the electron emission capability of the fluorescent display tube in the embodiment 1 was compared with that of the fluorescent display tube using the Ba—Al getter in the comparative example 1. At a normal temperature of 25° C., the pulse emission value was about 20%. After the fluorescent display tube was left in an atmosphere of 120° C. for 24 hours, the pulse emission value was about 110%. After the fluorescent display tube was illuminated for 4 hours at 25° C., the pulse emission value was about 90%. After the fluorescent display tube was further illuminated for 16 hours at 25° C., the pulse emission value was about 130%.

By disposing zirconium dioxide in a portion of a vacuum envelope, it is understood there is a possibility that a gas occlusion effect close to that of the conventional Ba—Al getter can be obtained.

Ascertainment of gas occlusion of zirconium dioxide:

In the fluorescent display tube in the embodiment 1, types of gas mainly absorbed were ascertained whether or not the gas occlusion layer containing zirconium dioxide can be used as a gas occlusion material for a fluorescent display tube.

Figure 17:
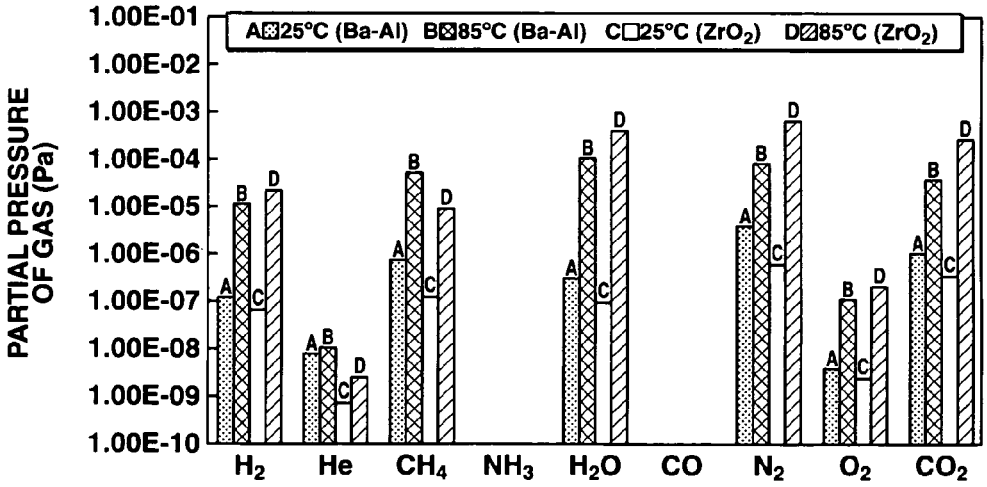
FIG. 17 is a graph showing types of gas generated at a normal temperature and types of gas generated at 85° C.

Referring to FIG. 17, it is understood that a gas current value released in the fluorescent display tube of the embodiment 1, which is disposed as a zirconium dioxide gas occlusion layer, is smaller than in the comparative example 1 using the conventional Ba—Al getter. Moreover, in the fluorescent display tube of the embodiment 1, $H_2O$ and $CO_2$, which adversely affect the vacuum tube characteristics of the fluorescent display tube, have a large value at 85° C. However, it is understood that the amount of $H_2O$, $CO_2$ is small at 25° C., being the temperature when a fluorescent display tube is actually used.

Judging from the above description, by disposing zirconium dioxide as a gas occlusion layer in a portion of the vacuum envelope, it is understood that a gas occlusion effect close to that of the conventional Ba—Al getter can be obtained.

The operational life characteristics when the fluorescent display tube in the comparative example 1 and the fluorescent display tube in the embodiment 1 are driven for 500 hours at normal temperatures were ascertained. Moreover, the operational life characteristics when the fluorescent display tube in the comparative example 1 and the fluorescent display tube in the embodiment 1 are driven for 500 hours in an atmosphere at 85° C. were ascertained.

Figure 18:
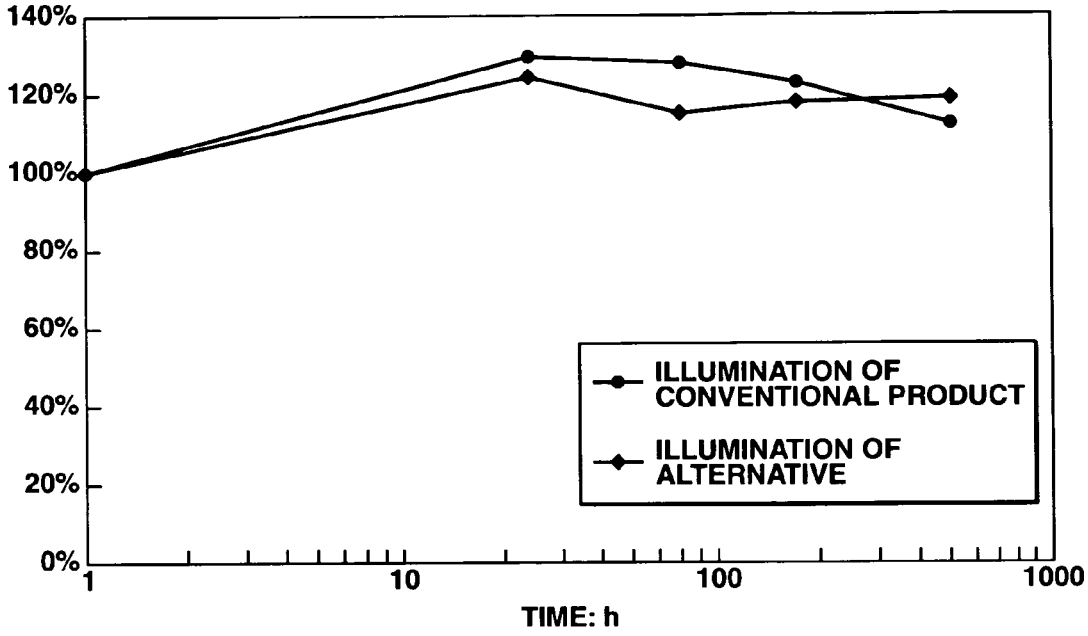
FIG. 18 is a graph plotting life characteristics when a fluorescent display tube has been driven for 500 hours at 25° C.
Figure 19:
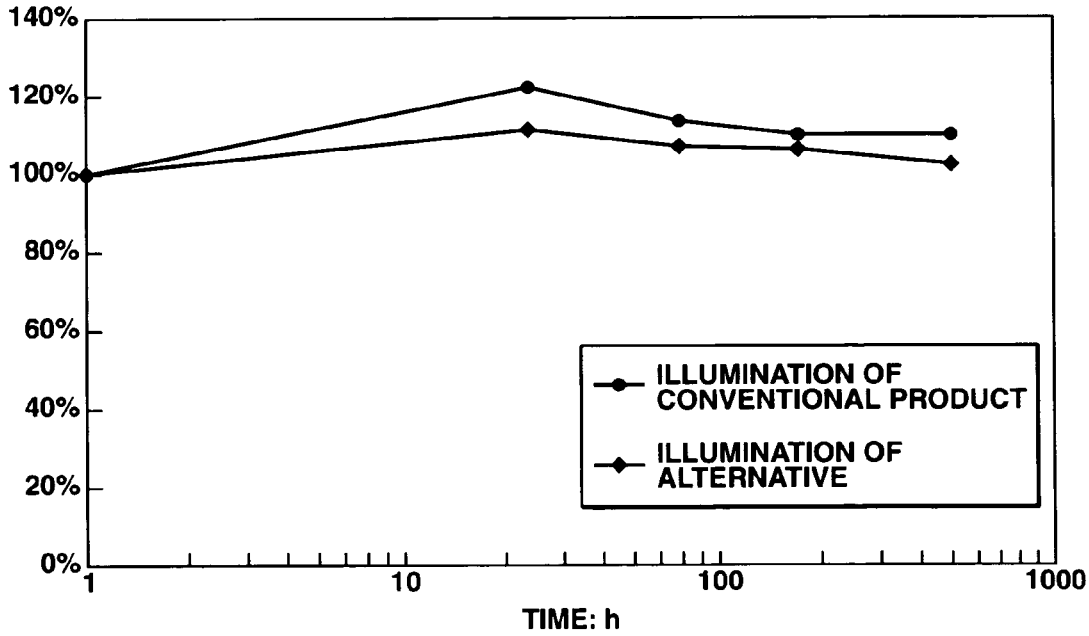
FIG. 19 is a graph plotting life characteristics when a fluorescent display tube has been driven for 500 hours in an atmosphere at 85° C.

Referring to FIGS. 18 and 19, the fluorescent display tube in the embodiment 1, in which zirconium dioxide is disposed as a gas occlusion material of the present invention, exhibited a sufficient characteristic of 100% or more with respect to the initial brightness even after illumination of 500 hours. In comparison with 110% of the fluorescent display tube in the comparative example 1 using the conventional Ba—Al getter, the initial brightness is low by about 10%. It is understood that the conventional getter is replaceable with the gas occlusion material of the present invention.

It was ascertained that the gas occlusion layer, acting as a gas occlusion material, containing zirconium dioxide can be used as a substitute for the conventional Ba—Al getter.

Zirconium suboxide ZrO, acting as a catalyst, has many unsolved points in the detail principle. Recently, zirconium suboxide ZrO, being a stable oxide, has been reviewed as to applications as catalyst and can be considered as an effective gas occlusion material. It is known that zirconium dioxide has high oxide defects. It is said that because zirconium dioxide has the property of transmitting oxygen ions at high temperatures, there may be the mechanism in which oxygen defects absorb gas molecules. Hence, it can be considered that zirconium dioxide is effective as a gas occlusion material.

An embodiment of a fluorescent display tube, or a self-luminous element, using a filament electron source, will be described below, in which zirconium dioxide is disposed therein. Moreover, an embodiment of a fluorescent display tube, or a self-luminous element, using a field emission electron source, will be described below, in which zirconium dioxide is disposed in a vacuum hermetic envelope.

Embodiment 2

Figure 2:
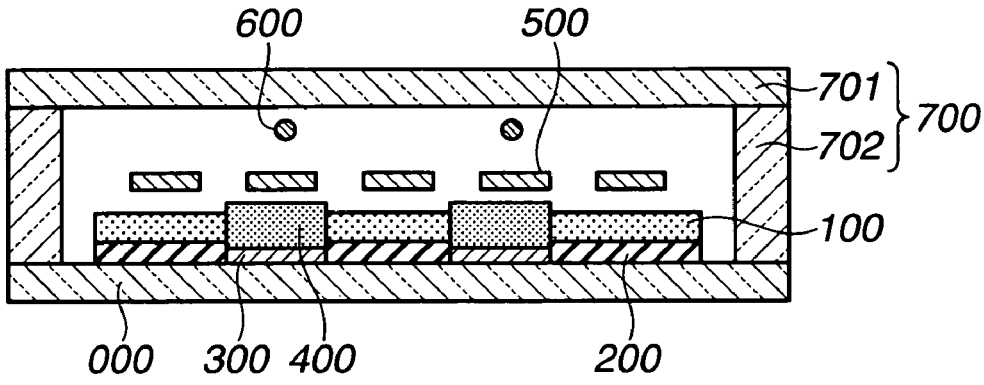
FIG. 2 is a schematic diagram illustrating a self-luminous element, according to a second embodiment of the present invention.

FIG. 2 shows a gas occlusion material disposed on the upper surface of an insulating layer containing a low melting point glass as a main component. Referring to FIG. 2, anodes 300 of an aluminum thin film are formed on the upper surface of the glass substrate 000. An insulating layer 200 containing a low melting point glass as a main component is formed on the upper surface of the anode and has openings in a display pattern. Each fluorescent substance layer 400 is formed on the upper surface of the anode. Using the screen printing process, a paste of zirconium dioxide used in the embodiment 1 is coated on the upper surface of the insulating layer 200 disposed around the fluorescent substance layers and in areas lacking fluorescent substance layers. Thus, the gas absorption layer 100 acting as a gas occlusion material is formed. Thereafter, a fluorescent display tube similar to that in the embodiment 1 was fabricated.

In the embodiment 2, the gas occlusion layer is disposed such that the surface thereof is exposed in the vacuum atmosphere. Thus, an effect similar to that in the embodiment 1 was obtained.

Embodiment 3

Figure 3:
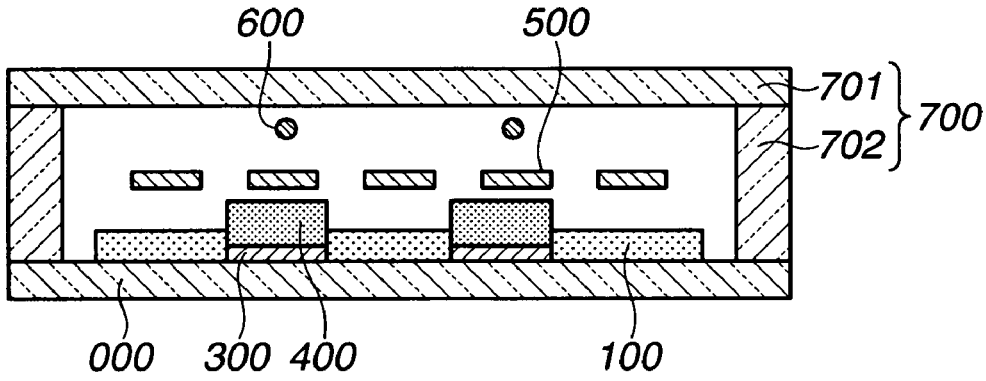
FIG. 3 is a schematic diagram illustrating a self-luminous element, according to a third embodiment of the present invention.

FIG. 3 shows a gas occlusion material, in place of an insulating layer containing a low melting point glass as a main component. Referring to FIG. 3, anodes 300 of an aluminum film are formed in a display pattern on the upper surface of the glass substrate 000. A fluorescent substance layer 400 is formed on the upper surface of each anode. Using the screen printing process, a paste of zirconium dioxide used in the embodiment 1 is coated at a portion, lacking anodes having openings in a display pattern, and on the upper surface of the insulating glass substrate. Thus, a gas occlusion layer 100 acting as a gas occlusion material is formed. Thereafter, a fluorescent display tube similar to that in the embodiment 1 was fabricated.

In the embodiment 3, the fluorescent display tube in the embodiment 2, which does not use the Ba—Al getter, and which is disposed such that the surface of the gas occlusion layer is exposed in a vacuum atmosphere, showed an effect similar to that in the embodiment 1.

Embodiment 4

Figure 4:
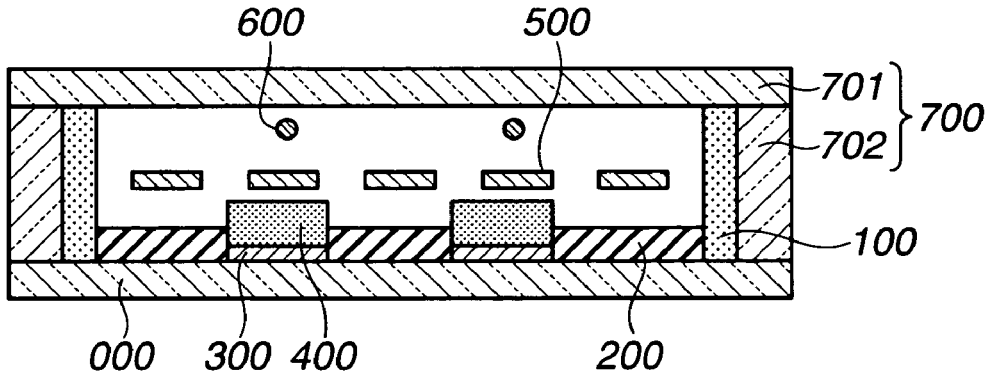
FIG. 4 is a schematic diagram illustrating a self-luminous element, according to a fourth embodiment of the present invention.

FIG. 4 is an example of a gas occlusion material disposed on the inner surface of a frame member constituting a hermetic envelope. As shown in FIG. 4, a gas occlusion layer acting as a gas occlusion material is coated and formed on the frame member 702 in the embodiment 1. The frame member 702, the front plate 701 and the glass substrate 000 are combined together. Thus, a fluorescent display tube, in which an envelope contains anodes, grids, and filaments, is fabricated. Thereafter, a fluorescent display tube similar to that in the embodiment 1 was fabricated.

The fluorescent display tube in the embodiment 4 exhibited an effect similar to that in the embodiment 1.

Embodiment 5

Figure 5:
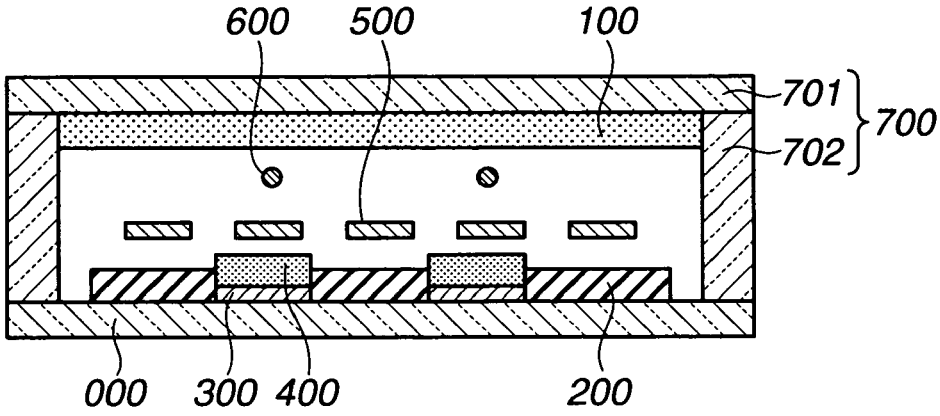
FIG. 5 is a schematic diagram illustrating a self-luminous element, according to a fifth embodiment of the present invention.

FIG. 5 is an example of a gas occlusion material disposed on the inner surface of the front plate constituting a hermetic envelope. As shown in FIG. 5, the glass substrate 000, the front plate 701, on which a gas occlusion layer 100 is formed by printing a paste containing zirconium dioxide through the screen printing process, and the frame member 702 are assembled. The paste is prepared by mixing a solvent made by mixing graphite acting as a conductive material of 1 wt % to 30 wt % and a solid content such as $ZrO_2$, with a vehicle in which ethyl cellulose is dissolved in a mixed solvent of butyl-carbitol and tarpinenol. Thus, a fluorescent display tube, which includes anodes, grids, and filaments, contained in an envelope, was fabricated. Thereafter, a fluorescent display tube similar to that in the embodiment 1 was fabricated.

Embodiment 6

Figure 6:
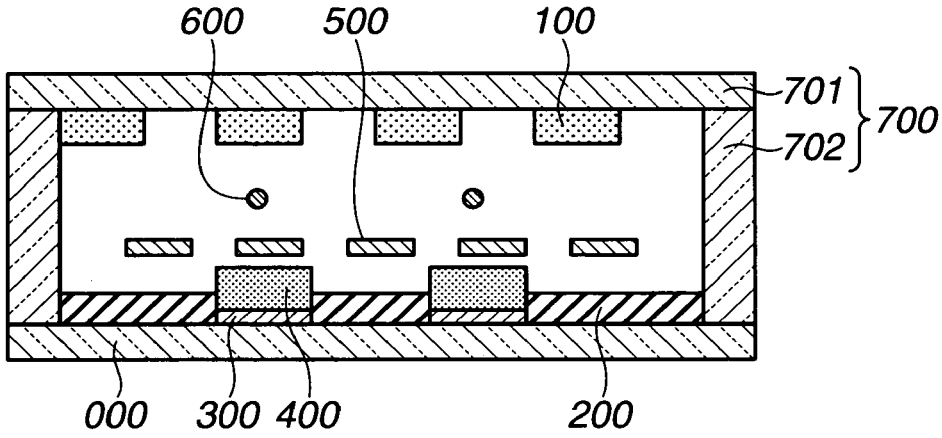
FIG. 6 is a schematic diagram illustrating a self-luminous element, according to a sixth embodiment of the present invention.

By forming the pattern as shown in FIG. 6, a gas occlusion layer in the embodiment 5 can be formed arbitrarily. In the embodiments 5 and 6, an effect similar to that in the embodiment 1 was obtained.

Embodiment 7

Figure 7:
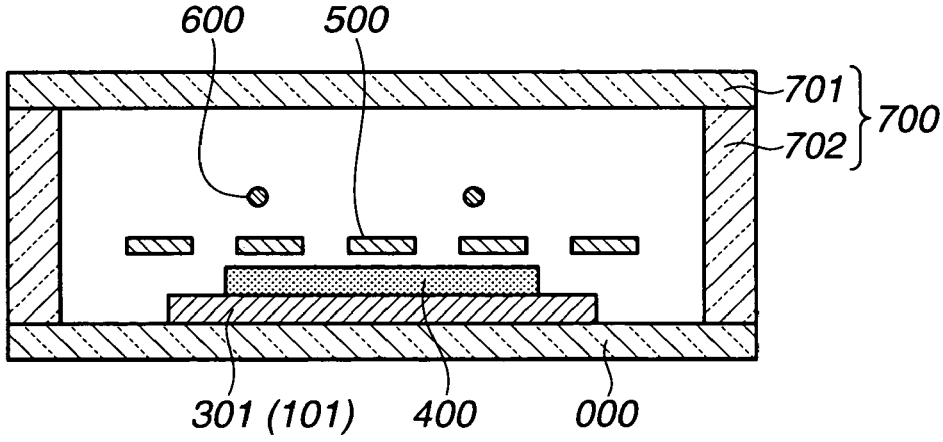
FIG. 7 is a schematic diagram illustrating a self-luminous element, according to a seventh embodiment of the present invention.

A paste is prepared by mixing graphite acting as a conductive material of 1 wt % to 30 wt % and a solid content such as zirconium dioxide, with a vehicle in which ethyl cellulose is dissolved in a mixed solvent of organic titanium, butyl-carbitol, and tarpinenol. As shown in FIG. 7, by coating the paste through the screen printing process, the anode conductor 301 having a gas occlusion property is formed. A paste prepared by mixing ZrO2 of 0.01 wt % to 99.99 wt % to graphite may be used for the anode conductor. After a fluorescent substance layer 400 for low velocity electron beam is formed on the upper surface of the anode overlying the anode substrate, the intermediate structure is baked at about 450° C. A fluorescent display tube was fabricated by applying a manner similar to that in the embodiment 1 to other elements. In the embodiment 7, an effect similar to that in the embodiment 1 was obtained.

Embodiment 8

Figure 8:
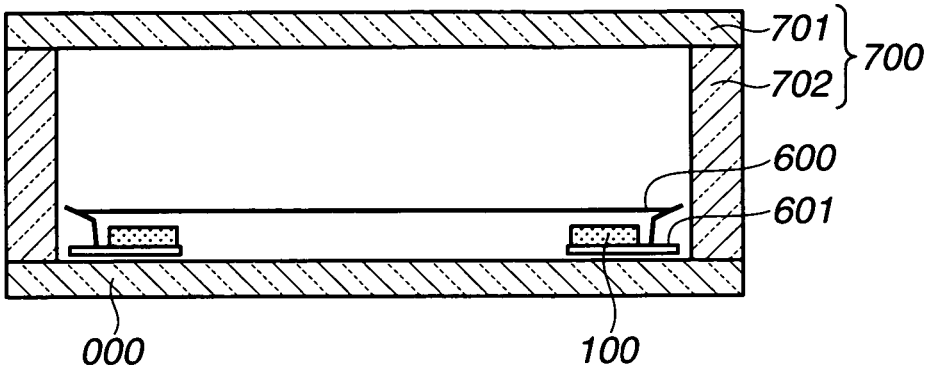
FIG. 8 is a schematic diagram illustrating a self-luminous element, according to a eighth embodiment of the present invention.

FIG. 8 is an example of a gas occlusion material of the present invention disposed to the filament support member 601. In the display element shown in FIG. 8, zirconium dioxide acting as the gas occlusion material of the present invention is disposed on the filament support member 601 in the fluorescent display tube, which includes as an electron source a filament similar to that in the embodiment 1. In order to coat zirconium dioxide, aerosol was prepared by dispersing zirconium dioxide in ethanol, acetone, water, or other solvent. The aerosol was sprayed to the filament support member 601 and then dried. In the embodiment 8, an effect similar to that in the embodiment 1 was obtained.

Embodiment 9

Figure 9:
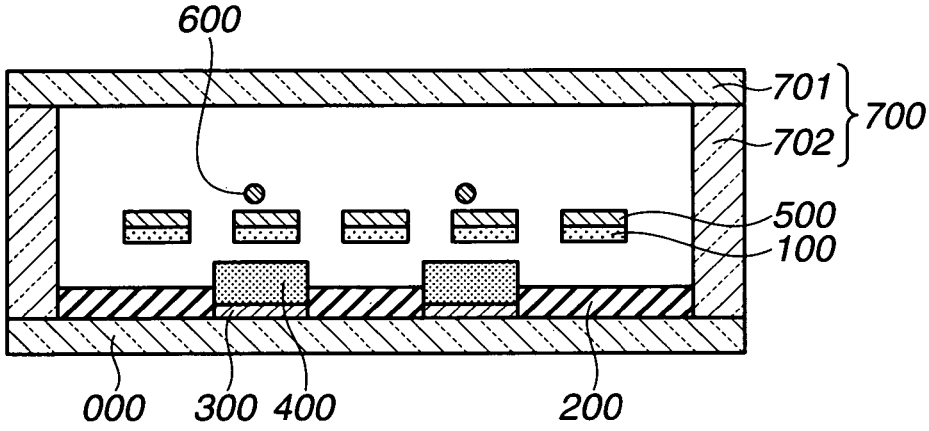
FIG. 9 is a schematic diagram illustrating a self-luminous element, according to a ninth embodiment of the present invention.

FIG. 9 shows an example of a gas occlusion material of the present invention disposed on the grid 500. As shown in FIG. 9, a fluorescent display tube, in which a filament electron source similar to that in the embodiment 1 is disposed, was fabricated. However, zirconium dioxide acting as a gas occlusion material of the present invention is disposed on the grid 500 opposed to the filament and on the side of the fluorescent substance layer 400. In order to coat the zirconium dioxide on the filament support member of the grid 500, aerosol was prepared by dispersing zirconium dioxide in ethanol, acetone, water, or other solvent. The aerosol was sprayed onto the filament support member 601 and then dried. The grid, on which the paste in the embodiments 1 and 5 is printed and coated and dried, may be used. In the embodiment 9, an effect similar to that in the embodiment 1 was obtained.

Embodiment 10

Figure 10:
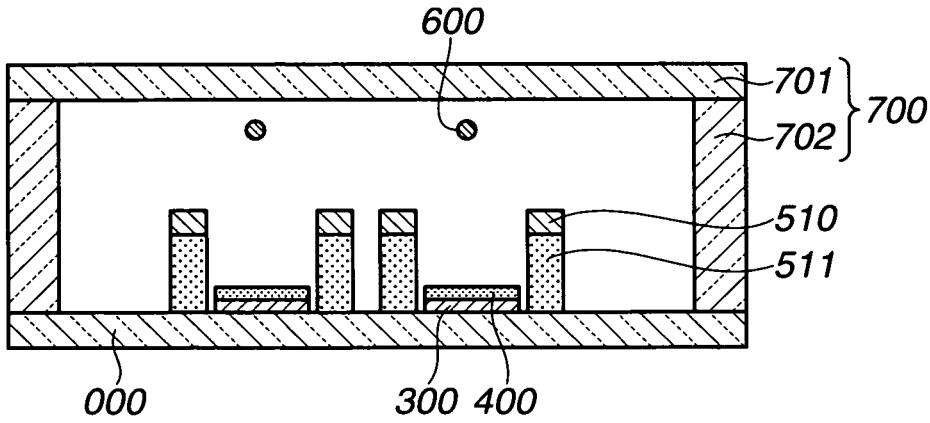
FIG. 10 is a schematic diagram illustrating a self-luminous element, according to a tenth embodiment of the present invention.

FIG. 10 is an example of a gas occlusion material of the present invention disposed on the rib spacers 511. As shown in FIG. 10, a fluorescent display tube including a filament electron source similar to that in the embodiment 1 was fabricated. However, grids are disposed around the fluorescent substance layers 500, respectively, and zirconium dioxide acting as a gas occlusion material of the present invention is mixed in each rib spacer.

The rib spacer 511, into which zirconium dioxide is mixed, is formed through printing a paste. The paste was prepared by mixing a low melting point glass of 30 wt % to 50 wt % and a solid content such as ZrO2 into a vehicle. The vehicle is made by dissolving an organic binder such as ethyl cellulose in a mixed solvent of organic titanium, butyl-carbitol, and terpinenol. In the embodiment 10, an effect similar to that in the embodiment 1 was obtained.

Embodiment 11

Figure 11:
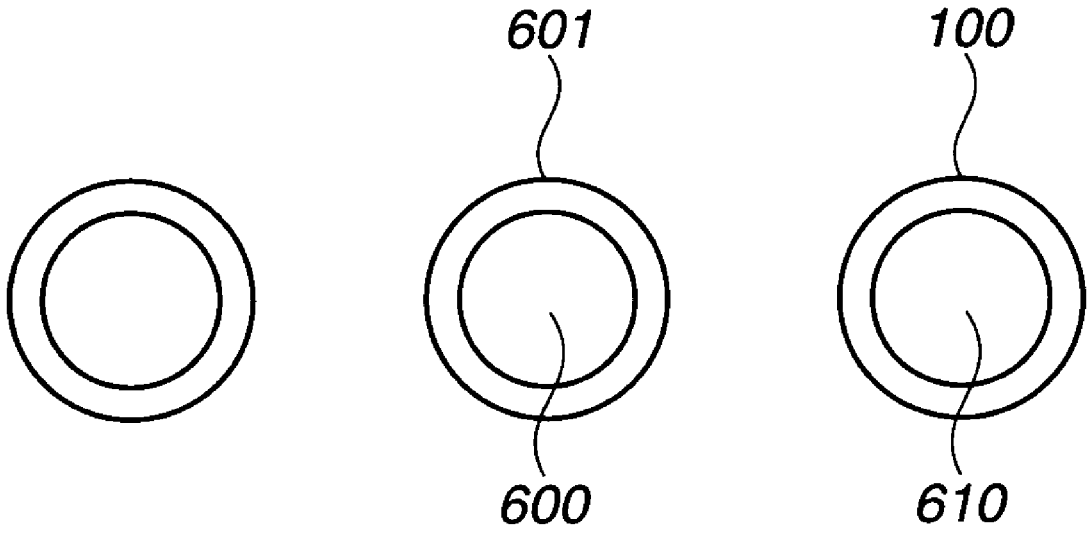
FIG. 11 is a schematic diagram illustrating a self-luminous element, according to an eleventh embodiment of the present invention.

FIG. 11 is an example of a gas occlusion material of the present invention formed on the core line sustained in parallel to the filament cathode. As shown in FIG. 11, a dispersion solution made by dispersing zirconium oxide in a solvent in which an acrylic binder is dissolved in acetone was prepared. Zirconium dioxide is electro-deposited on tungsten or other metals through the electrodeposition process to form the gas occlusion layer 100.

The metal material on which zirconium dioxide is electro-deposited is mounted in a fluorescent display tube, for example, in parallel to the filament cathode. In other structure, the fluorescent display tube was fabricated in a manner similar to that in the embodiment 1. The metal material having the gas occlusion layer 100, electro-deposited in the completed fluorescent display tube, is separated from the filament and thus can be activated externally through resistance heating such as electric conduction.

In the embodiment 11, a combination of the metal material and the Ba—Al getter resulted in a fluorescent display tube having the reliability higher than the embodiment 1.

Embodiment 12

Figure 12A:
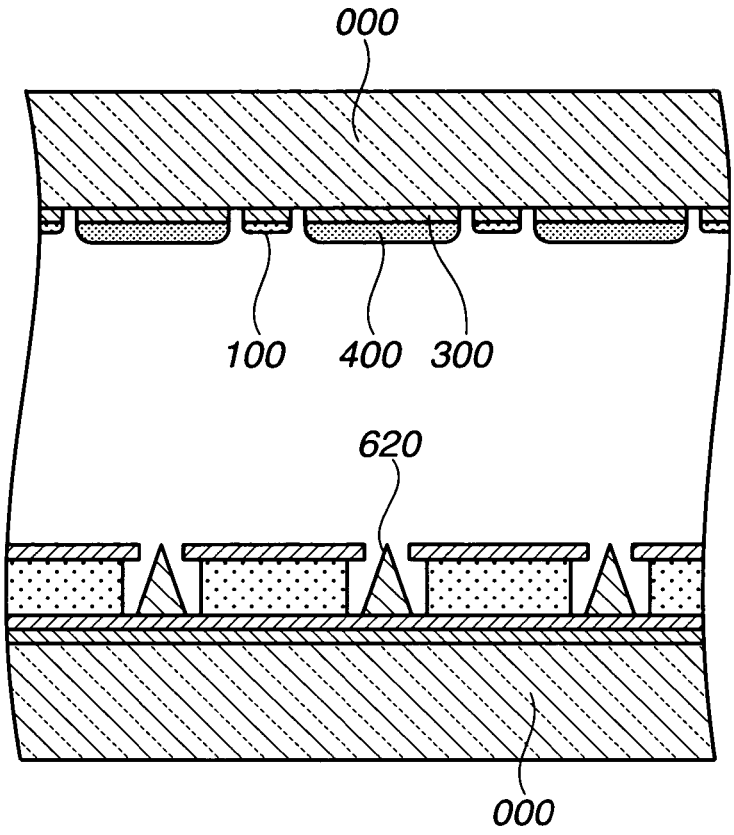
FIG. 12 is a schematic diagram illustrating a self-luminous element, according to a twelfth embodiment of the present invention.
Figure 12B:
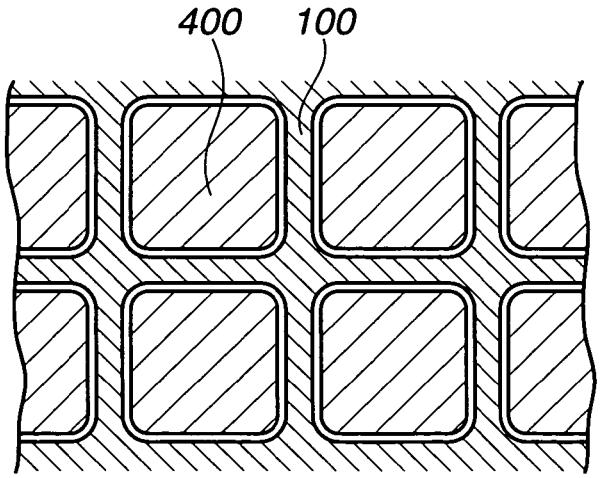

FIG. 12 is an example of a gas occlusion material disposed in a fluorescent display tube using Spint-type field emission elements as electron sources. As shown in FIGS. 12(*a*) and 12(*b*), a fluorescent display tube includes a thin box-like envelope, which is formed of, an insulating and translucent anode substrate and an insulating cathode substrate integrally sealed via insulating spacer members. The spacing between the substrates is set to, for example, 500 μm or less.

An exhaust hole (not shown) is formed at a corner of the cathode substrate 2 to evacuate gases remaining in the envelope. After evacuation, the exhaust hole is sealed and the inside of the envelope 2 is maintained at a high vacuum degree of $1\times10^{-3}$ Pa or less.

Vertical field emission elements 620, each acting as an electron source, are formed on the cathode surface confronting the anode substrate in the envelope. Each field emission element 620 has a cathode electrode formed on the inner surface of the cathode substrate, a resistance layer formed on the cathode electrode, an insulating layer such as silicon oxide formed on the resistance layer, a gate electrode formed on the insulating layer, and a cone emitter formed on the cathode electrode within an opening formed through both the insulating layer and the gate electrode. Some field emission devices (FEDs) do not have a resistance layer between the cathode electrode 5 and the insulating layer.

An anode electrode acting as a display section is formed on the inner surface of the anode substrate in the envelope 3 and at a position confronting a field emission element. The anode electrode is formed of a translucent anode conductor 300 such as ITO formed on the anode substrate 1 and a fluorescent substance layer 400 coated in a predetermined shape, for example, in a dot matrix, on the anode conductor.

Gas occlusion layers 100, spaced at small intervals, are coated on the inner surface of the anode substrate in the envelope and around fluorescent substance layers respectively forming display sections. The surface of each gas occlusion layer 100 is exposed in the atmosphere in the envelope 3. The gas occlusion layer 100 absorbs gases released in the envelope, or specifically, gases generated when the fluorescent substance layer 400 glows in response to impingement of electrons from a field emission element.

In the twelfth embodiment, when electrons emitted from the field emission element 620 glows strike the fluorescent substance layer 400 on the anode electrode, thus causing excitation light emission. The light emission is observed via the anode conductor and via the translucent anode substrate. Part of the energy when the electrons strike the fluorescent substance layer 400 is converted into heat while the fluorescent substance layer 400 is decomposed to generate gases. The gas occlusion layer 100 surrounding the corresponding fluorescent substance layer 400 occludes the generated gases. At this time, the gas occlusion layer 100 works as a shielding member when light emission of the fluorescent substance layer 400 is viewed from the anode substrate side.

According to the twelfth embodiment, gases drifting above the display section during the light emission by excitation of the fluorescent substance layer 400 are efficiently absorbed with the gas occlusion layer 100 surrounding the fluorescent substance layer 400. Therefore, the gas occlusion layer 400 can absorb gases uniformly all over the display sections in the envelope, thus maintaining the inside of the envelope in high vacuum degree. A reduction of gases drifting above the display section enables reduced contamination of the emitter of the field emission element due to the gasses. As a result, the emission and luminous brightness can be maintained, so that the operational life of the fluorescent display can be prolonged, compared with that of the conventional one.

In the twelfth embodiment, the gas occlusion layers 100 are formed on the inner surface of the anode substrate at small intervals so as to surround the fluorescent substance layer 400. However, the gas occlusion layers 100 may be formed in contact with the anode conductor and without any spacing, such that the gas occlusion material 100 is at the same potential as that of the anode conductor when a positive voltage is applied to the anode conductor. In this case, the gas occlusion material layer 100 is activated with impingement of electrons, so that the gas occlusion capability can be improved.

Embodiment 13

In embodiment 13, a display element, in which zirconium dioxide acting as a gas occlusion material of the present invention, is fabricated. The display element uses carbon type electron emission elements, each having a carbon electron source, in place of the Spint-type electron sources. This configuration exhibited an effect similar to that in the twelfth embodiment.

Embodiment 14

In embodiment 14, a display element, in which zirconium dioxide acting as a gas occlusion material of the present invention, is formed. The display element uses MIM type electron emission elements, each in a metal/insulating thin film/metal structure, in place of the Spint-type electron sources. This configuration exhibited an effect similar to that in the twelfth embodiment.

In the embodiments described above, the gas occlusion material is applied to display elements having electron sources and fluorescent substance layers in a vacuum hermetic envelope. Here, as the display elements are enumerated fluorescent display tubes including filament cathodes as electron sources, Spint-type field emission display devices, display elements using carbon electron emission sources, and display elements using MIM-type electron emission elements. However, the gas occlusion material containing $ZrO_x$ (where $1\leqq x\leqq 2$) according to the present invention can be applied to display devices in which the atmosphere in a hermetic envelope must be maintained in an initial state, in addition to the case where the inside of an envelope is maintained in vacuum.

INDUSTRIAL APPLICABILITY

Unlike the conventional fluorescent display tube using the Ba—Al getter, an electron beam excitation fluorescent substance, being a kind of self-luminous element using a novel gas occlusion material of the present invention, can provide an inexpensive, long-life fluorescent display tube, without constraints in the Ba—Al getter installation space. Accordingly, the industrial applicability is that new applications for fluorescent display tubes usable more easily can be broadened.

As described above, the gas occlusion material containing $ZrO_x$ (where $1\leqq x\leqq 2$) according to the present invention is made as a paste, together with various materials. The paste may be disposed as a gas occlusion layer to a self-luminous element. Furthermore, aerosol is prepared by dispersing the paste in ethanol, acetone, water, or other solvent. Thus, the aerosol can be applied on the surfaces of column supports or other members of a display element.

Even in elements such as fluorescent display tubes, plasma display devices, EL elements, which require a vacuum hermetic vessel, the new gas occlusion material can be used as an inexpensive, long-life gas occlusion material. This, needless to say, can broaden new applications of self-luminous elements.

What is claimed is:

1. A self-luminous element comprising:

a vacuum hermetic envelope;

an electron source disposed inside said vacuum hermetic envelope;

a fluorescent substance layer disposed inside said vacuum hermetic envelope, for light emitting in response to electrons irradiated from said electron source; and a gas occlusion material disposed inside said vacuum envelope, said gas occlusion material containing $ZrO_x$ where $1 \leqq x \leqq 2$, having oxygen defects, said gas occlusion material being disposed so as to be exposed to an atmosphere in said hermetic enclosure;

wherein said gas occlusion material having a conductivity and containing graphite and $ZrO_x$, where $1 \leqq x \leqq 2$, having oxygen defects is exposed in an atmosphere inside said hermetic enclosure.

2. The self-luminous element defined in claim 1, wherein said electron source comprises a filament shaped electron source.

3. The self-luminous element defined in claim 1, wherein said electron source comprises a field emission electron source.

4. The self-luminous element defined in claim 1, wherein said gas occlusion material containing $ZrO_x$, where $1 \leqq x \leqq 2$, having oxygen defects is formed in a film state over an inner surface of said hermetic enclosure.

5. The self-luminous element defined in claim 1, wherein said gas occlusion material containing $ZrO_x$, where $1 \leqq x \leqq 2$, having oxygen defects is formed in a film state on the upper surface of an insulating layer overlying an inner surface of said hermetic enclosure.

6. The self-luminous element defined in claim 1, wherein said gas occlusion material containing $ZrO_x$, where $1 \leqq x \leqq 2$, having oxygen defects is formed to a grid member disposed above said fluorescent substance layer.

* * * * *

UNITED STATES PATENT AND TRADEMARK OFFICE

CERTIFICATE OF CORRECTION

PATENT NO. : 7,459,842 B2
APPLICATION NO. : 11/042430
DATED : December 2, 2008
INVENTOR(S) : Shiraga et al.

It is certified that error appears in the above-identified patent and that said Letters Patent is hereby corrected as shown below:

On the Title page please add
Item -- (30) Foreign Application Priority Data
Jan. 26, 2004 (JP) . . . . . .2004-017709 --

Signed and Sealed this

Seventeenth Day of March, 2009

John Doll

JOHN DOLL
*Acting Director of the United States Patent and Trademark Office*